US006058909A

United States Patent [19]

Nakashima

[11] Patent Number: 6,058,909

[45] Date of Patent: May 9, 2000

[54] CYLINDER IDENTIFYING APPARATUS FOR AN INTERNAL-COMBUSTION ENGINE

[75] Inventor: Masami Nakashima, Hyogo, Japan

[73] Assignee: Mitsubishi Denki Kabushiki Kaisha, Tokyo, Japan

[21] Appl. No.: 09/207,325

[22] Filed: Dec. 7, 1998

[30] Foreign Application Priority Data

Jun. 15, 1998 [JP] Japan ..... 10-167110

[51] Int. Cl.[7] ..... F02P 5/00

[52] U.S. Cl. ..... 123/406.59; 123/406.24

[58] Field of Search ..... 123/406.59, 406.24, 123/476

[56] References Cited

U.S. PATENT DOCUMENTS

| | | | |
|---|---|---|---|
| 4,265,210 | 5/1981 | Hanisko | 123/476 |
| 4,284,052 | 8/1981 | Hanisko | 123/476 |
| 4,378,004 | 3/1983 | Petrie | 123/476 |
| 4,760,827 | 8/1988 | Schreiber et al. | 123/476 |
| 4,766,865 | 8/1988 | Hartel | 123/476 |
| 4,936,277 | 6/1990 | Deutsch et al. | 123/476 |
| 5,460,134 | 10/1995 | Ott et al. | 123/476 |
| 5,560,336 | 10/1996 | Takahashi et al. | 123/406.24 |

FOREIGN PATENT DOCUMENTS 7-58058 6/1995 Japan .

*Primary Examiner*—John Kwon

[57] ABSTRACT

In a cylinder identifying apparatus for an internal-combustion engine for identifying the state of a cylinder from rotation signal generating device of one system, reverse is detected on the basis of the occurrence period of a rotation signal when the engine is reversed, and erroneous control due to the reverse is avoided.

In the cylinder identifying apparatus for an internal-combustion engine, there is provided reverse identifying device 7 for identifying reverse on the basis of the occurrence period of a rotation signal when the engine is reversed to avoid any erroneously-controlled state at the time of the engine reverse.

2 Claims, 4 Drawing Sheets

CYLINDER IDENTIFYING APPARATUS FOR AN INTERNAL-COMBUSTION ENGINE

BACKGROUND OF THE INVENTION

1. Field of the Invention

The present invention relates to a cylinder identifying apparatus for an internal-combustion engine which identifies a cylinder from a signal from one system of signal generating means.

2. Description of Related Art

In order to control the ignition timing and the fuel injection quantity of an internal-combustion engine, a signal synchronized with the rotation of the engine is used. This signal generator normally detects the rotation of the crank shaft of the engine or a cam shaft which rotates in synchronization with the crank shaft at half of the number of revolutions thereof.

An example of such signal generating means is shown in FIGS. 4 and 5. A window 3 is provided at a place corresponding to a desired detection angle on a rotary disk. Referring to FIG. 4, numeral 1 denotes a cam shaft which rotates in synchronization with an engine (not shown); numeral 2 denotes a rotary disk mounted to the cam shaft 1; numeral 4 denotes a light emitting diode; and numeral 5 denotes a photodiode which receives the output light from the light emitting diode 4 through the window 3 provided on the rotary disk 2.

In FIG. 5, numeral 6 denotes an amplifier circuit, connected to the photodiode 5, for amplifying an output signal from the photodiode 5; and numeral 7 denotes an output transistor for an open collector connected to the amplifier circuit 6. Such a signal as shown in FIG. 7 is outputted from the signal generating means (See FIG. 6). A crank angle reference signal (SGT) shown in FIG. 7 reverses at a predetermined crank angle for each cylinder, and is used as a reference signal for the crank angle.

In order to identify a reference position corresponding to each cylinder, a signal for cylinder identification is caused to be additionally outputted immediately after a reference position signal for cylinder #1 occurs. It is described also in Japanese Patent Publication No. 7-58058 that an occurrence interval between these signals is measured to detect timing of a specified cylinder (cylinder #3 in FIG. 7) on the basis of a ratio of occurrence interval between two continuous sections, and that after the specified cylinder is identified, other cylinders will be identified in order on the basis thereof.

The addition of an identification signal as described above enables a specified cylinder to be identified, and control for each cylinder can be performed by identifying other cylinders in order. In this respect, an output signal from rotation signal generating means 8 is inputted into a microcomputer 10 through an interface circuit 9 as shown in FIG. 6 to control the ignition, the fuel injection and the like of the cylinder which has been identified in synchronization with such input signal.

If, however, a starting switch is turned off by an operator's failure or the like at the time of starting, during compression stroke (at crank angle position before top dead center) before the internal-combustion engine completely starts, the internal-combustion engine may reverse to stop.

In this case, since it is not capable of recognizing a reversed state, the microcomputer 10 erroneously controls in response to a crank angle reference signal (SGT) detected at the time of the reverse, thus possibly damaging the internal-combustion engine.

For example, when reversed at time t2 (during compression stroke) immediately after passing the first reference crank angle B75° of cylinder #4 forward as shown in FIG. 8, the microcomputer 10 erroneously recognizes the signal at the first reference crank angle B75° of the cylinder #4 at time t3 as a signal at a second reference crank angle B5° of the cylinder #4 which has been passed reversed, and also recognizes the signal at the first reference crank angle B75° of the same cylinder #4 at time t4 as a signal at the first reference crank angle B75° of the next cylinder #2 to erroneously control the cylinder #2.

Also, when reverse occurs before the termination of cylinder identification (before an additional signal for cylinder identification is specified), the microcomputer 10 recognizes a normal cylinder signal as an additional signal for cylinder identification on the basis of a rate of a signal occurrence interval at the reversed cylinder to a signal occurrence interval at the next cylinder to control an erroneous cylinder.

BRIEF SUMMARY OF THE INVENTION

Object of the Invention

When the engine is reversed because of OFF operation or the like of the starting switch and erroneous control is performed in response to a crank angle reference signal (SGT) detected at that time as described above, a conventional cylinder identifying apparatus for an internal-combustion engine has a problem in that it causes an unstable combustion state due to the erroneous control to adversely affect the internal-combustion engine because no countermeasures to prevent erroneous recognition for the reference crank angle have been taken.

The present invention has been achieved in order to solve the above-described problem, and its object is to provide a cylinder identifying apparatus for an internal-combustion engine capable of avoiding an erroneously-controlled state at the time of reverse by discriminating any reversed state from the occurrence interval of reference crank angle signals.

SUMMARY OF THE INVENTION

A cylinder identifying apparatus for an internal-combustion engine according to the present invention comprises rotation signal generating means for generating a first position signal generated correspondingly to a cylinder and additionally a second position signal subsequently to the first position signal corresponding to a specified cylinder; measuring means for measuring a signal interval; ratio computing means for computing the ratio of signal occurrence interval between two predetermined sections; signal identifying means for specifying a predetermined signal from second computation based on plural computation results by the ratio computing means; cylinder presuming means for presuming a cylinder by learning a signal pattern after specifying a second position signal additionally generated, and after the learning, by rotating the learning signal pattern in synchronization with the signal; and reversed state identifying means for identifying as a reversed state if on identifying the additional signal, the interval of a section immediately before it, is larger than that of the signal interval on the same level two sections before it so that the recognition of the second position signal is withdrawn on identifying the reversed state.

Also, cylinder identification for an internal-combustion engine according to another aspect of the present invention is to clear the signal identification result and the learning signal pattern for cylinder presumption if the result of the signal identifying means and that of the cylinder presuming means disagree with each other after the signal interval due to the measuring means exceeds a criterion value.

DETAILED DESCRIPTION OF THE PREFERRED EMBODIMENTS

Embodiment 1

Hereinafter, with reference to the drawings, the description will be made of an embodiment according to the present invention.

Figure 1:
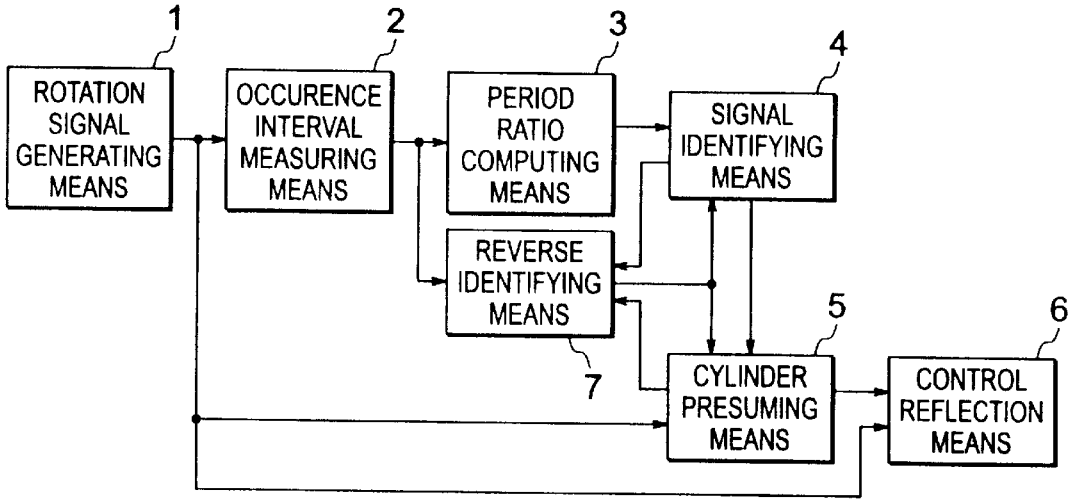
FIG. 1 is a block diagram showing essential portions of a cylinder identifying apparatus for an internal-combustion engine according to an embodiment of the present invention.

FIG. 1 is a control block diagram for a cylinder identifying apparatus for an internal-combustion engine according to this embodiment. This cylinder identifying apparatus for an internal-combustion engine comprises rotation signal generating means 1 which additionally generates a second position signal subsequently to a first position signal generated at equal intervals correspondingly to each of a plurality of cylinders for rotationally driving an internal-combustion engine; occurrence interval measuring means 2 for measuring a signal occurrence interval; period ratio computing means 3 for computing a ratio of signal occurrence interval between two predetermined sections on the basis of plural measuring results by the occurrence interval measuring means 2; signal identifying means 4 for specifying a predetermined signal from among signal groups on the basis of plural computing results by the period ratio computing means 3; cylinder presuming means 5 for presuming a cylinder on the basis of a signal pattern learned after a second position signal added is specified; reversed state identifying means 7 for identifying as a reversed state if when the second position signal added has been identified, the interval of a section immediately before it is larger than that of a signal section on the same level two sections before it; and control reflection means 6 for controlling the ignition, the fuel injection and the like of the corresponding cylinder after the commencement of the cylinder presumption by the cylinder presuming means 5.

Next, the description will be made of the operation in this embodiment.

The rotation signal generating means 1 is composed of a waveform shaping circuit for pulsing photo transistor output signals or electromagnetic pickup output signals which have been provided correspondingly to, for example, each reference crank angle B75° and B5°0 of the crank shaft.

Figure 2:
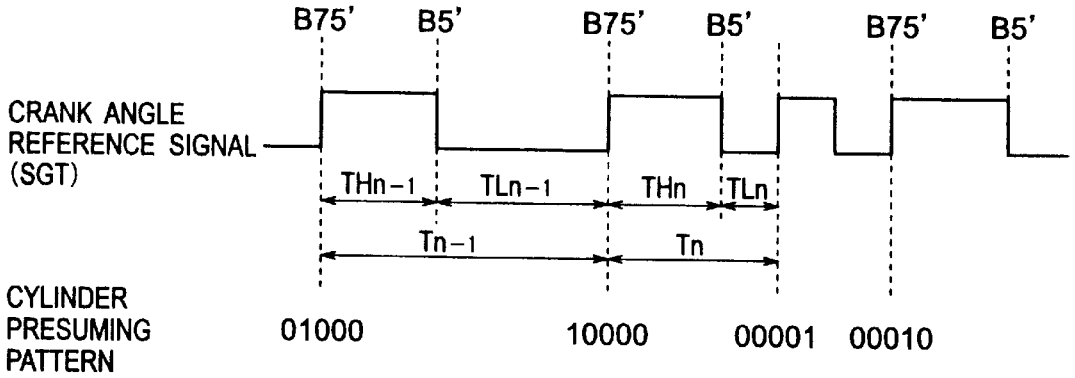
FIG. 2 is a waveform view showing a signal outputted from rotation signal generating means according to this embodiment.

Accordingly, the rotation signal generating means 1 outputs first reference crank angle pulses corresponding to B75°0 and B5° for each cylinder of the internal-combustion engine, and a second additional pulse (second position signal) for identifying a specified cylinder as shown in FIG. 2.

The occurrence interval measuring means 2 of FIG. 1 measures a high period (THn) and a low period (TLn) of a pulse outputted by the rotation signal generating means 1 respectively, and also computes a period (Tn) for crank angle of 180° obtained by adding the high period to the low period.

The period ratio computing means 3 determines the period ratio on the basis of a period measured by the occurrence interval measuring means 2 using the following equation:

$$\text{Period ratio}(\alpha)=THn/Tn$$

If the period ratio ($\alpha$) is larger than the criterion value in the signal identifying means 4, the additional pulse is specified.

At the timing at which the signal identifying means 4 specifies the additional pulse, the reverse determining means 7 compares the present low period TLn with the last low period TLn-1, and withdraws the specifying of the additional pulse by the signal identifying means 4 if TLn>TLn-1.

If the additional pulse is specified by the signal identifying means 4 and reverse is not identified by the reverse identifying means 7, it is regarded as terminated cylinder identification, and cylinder presumption using the cylinder pattern learned is started by the cylinder presuming means 5.

Also, if the detection result of an additional pulse by the signal identifying means 4 does not conform to the additional pulse by the cylinder presuming means 5 after it is detected by the reverse identifying means 7 that the measuring result by the occurrence interval measuring means 2 exceeds the criterion value, a cylinder pattern used by the cylinder presuming means 5 will be initialized and the cylinder identification will be done over again by the signal identifying means 4.

If the cylinder identification is terminated and cylinder presumption is started by the cylinder presuming means 5, the control reflection means 6 controls the ignition, the fuel injection and the like of the corresponding cylinder.

Figure 3:
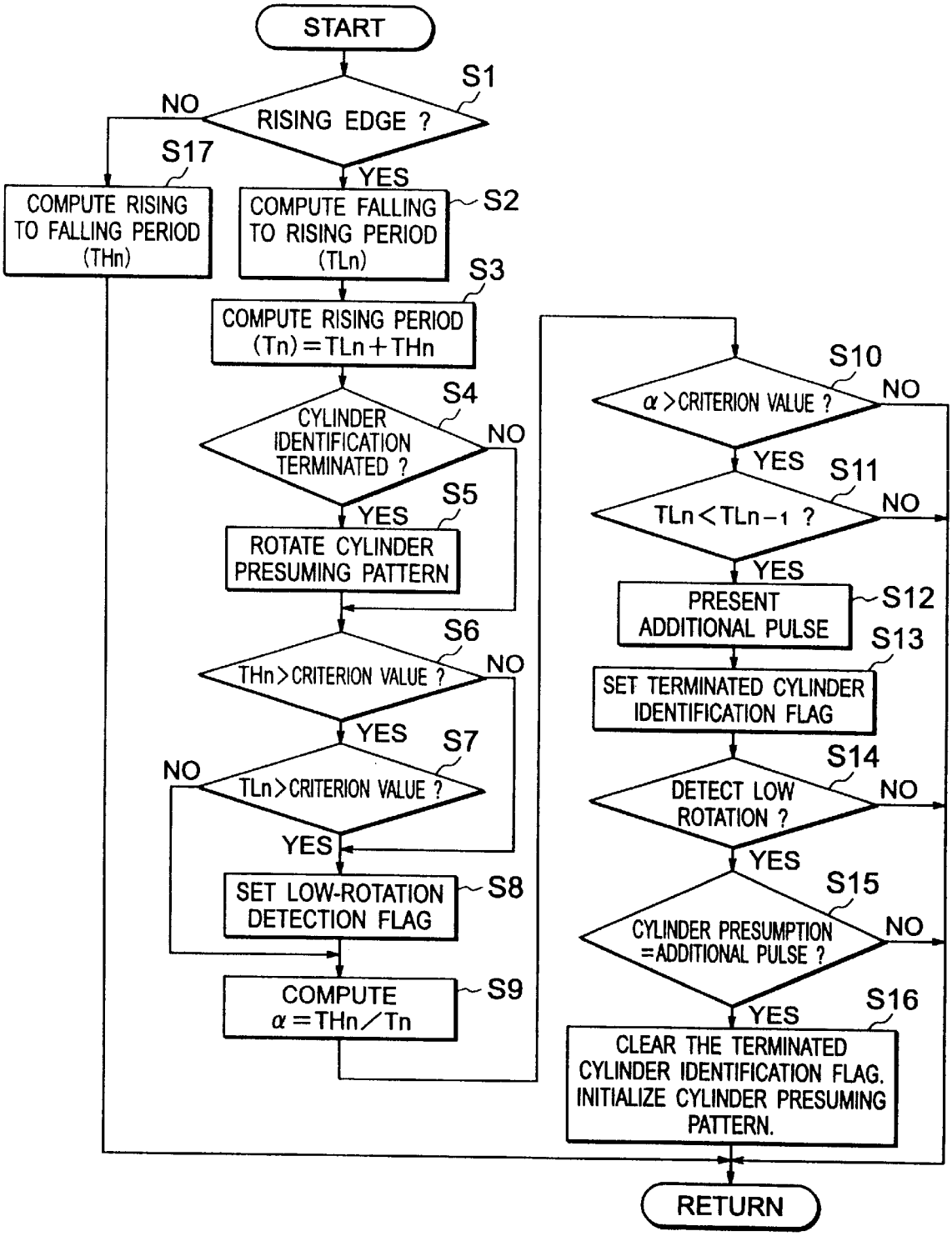
FIG. 3 is a flowchart showing the operation in this embodiment.
Figure 4:
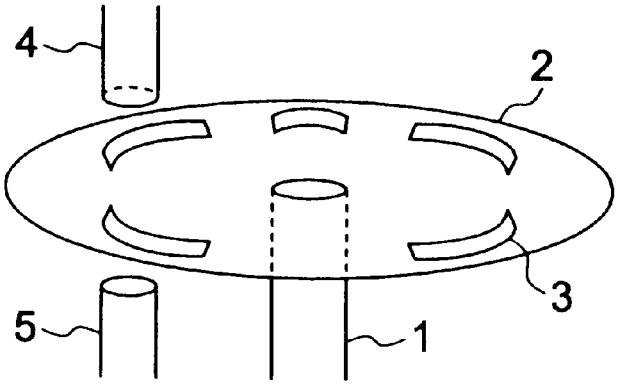
FIG. 4 is a structural view showing rotation signal generating means.
Figure 5:
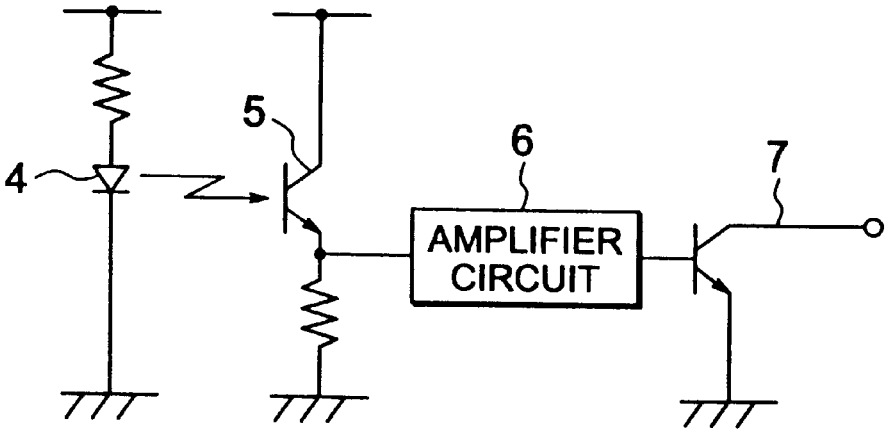
FIG. 5 is a signal processing circuit for the rotation signal generating means.
Figure 6:
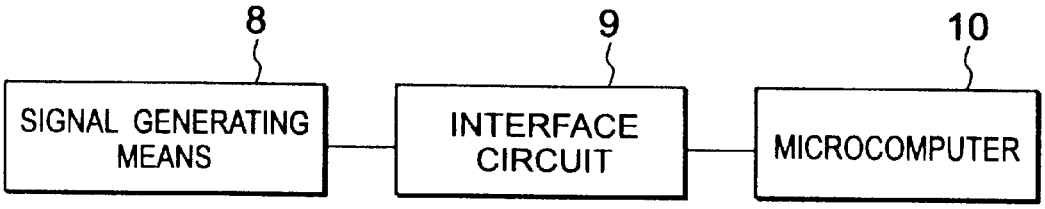
FIG. 6 is a schematic block diagram showing a cylinder identifying apparatus for an internal-combustion engine.
Figure 7:
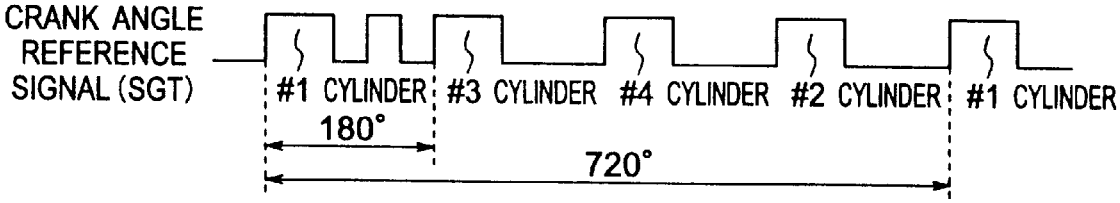
FIG. 7 PRIOR ART
FIG. 7 is a waveform view for a signal outputted from conventional rotation signal generating means.
Figure 8:
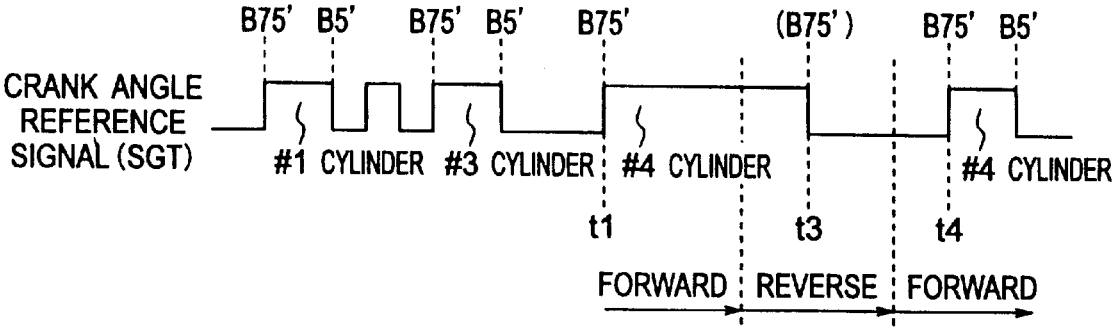
FIG. 8 PRIOR ART
FIG. 8 is a waveform view for a signal in a reversed state in conventional rotation signal generating means.

Next, with reference to the flowchart of FIG. 3, the description will be made of the operation in this embodiment. The microcomputer 10 shown in FIG. 6 measures a signal period in step S2 or step S17 corresponding to the occurrence interval measuring means 2 on the basis of angle signal input (FIG. 2) which is transmitted from the signal generating means 8 through the interface circuit 9 at each time.

In step S1, it is discriminated whether the input edge is a rising edge (for example, B75° edge) or a falling edge (for example, B5° edge), and if the rising edge, a period (TLn) between falling edge and rising edge is measured in step S2, while if the falling edge, a period (THn) between rising edge and falling edge is measured in step S17. Also, a period (Tn) between the rising edges is computed by adding the respective periods in step S3.

If the cylinder identification has been terminated in step S4, the process proceeds to step S5 to rotate the cylinder pattern for the cylinder presuming means to the left. The cylinder pattern is pattern information of five bits corresponding to number of cylinders of 4+additional pulse 1 as shown in FIG. 2, and the rightmost bit corresponds to the current input pulse. When this bit is 1, it is identified as an additional pulse.

In steps S6 and S7, if the period (THn or TLn) between the input edges is larger than the criterion value, a low-rotation detection flag is set. The criterion value is a value used to identify low rotation at not higher than the cranking rotation frequency, and when low rotation is detected here, is used for the reverse identifying means 7 because there is a possibility of reverse.

Step S9 corresponds to the period ratio computing means 3, and computes a period ratio using a period measured by the occurrence interval measuring means 2.

$$\text{Period ratio}(\alpha)=THn/Tn$$

Step S10 corresponds to the signal identifying means, and discriminates whether or not the period ratio ($\alpha$)>criterion value. If affirmative, the present pulse is identified as an additional pulse.

The next step S11 corresponds to the reverse identifying means 7. When it has been identified as an additional pulse in the step S10, TLn is compared with TLn-1, and if TLn<TLn-1, the process will proceed to step S12 and step S13 to decide that the present pulse is an additional pulse, setting a flag to terminate cylinder identification. If TLn≧TLn-1, the identification as an additional pulse is withdrawn because there is a possibility of reverse.

When the additional pulse has been decided, the process proceeds to step S14 to discriminate whether or not a low-rotation detection flag has been set in step S8, and if affirmative, the process proceeds to step S15 because there is a possibility of reverse. In the step S15, it is discriminated whether or not the cylinder presuming pattern is an additional pattern this time, and if not the additional pulse, it is identified as occurrence of reverse. The process proceeds to step S16 to clear the flag to terminate the cylinder identification, initializing the cylinder presuming pattern.

As described above, according to the present invention, the cylinder identifying apparatus for an internal-combustion engine comprises rotation signal generating means for generating a first position signal which occurs correspondingly to a cylinder and additionally a second position signal subsequently to the first position signal which corresponds to a specified cylinder; measuring means for measuring a signal interval; ratio computing means for computing the ratio of signal occurrence interval between two predetermined sections; signal identifying means for specifying a predetermined signal by means of second computation based on plural computation results by the ratio computing means; cylinder presuming means for presuming a cylinder by learning a signal pattern after specifying the second position signal added, and after the learning, by rotating the learning signal pattern in synchronization with the signal; and reversed state identifying means for identifying as a reversed state if on identifying the second position signal added, the interval of a section immediately before it is larger than that of the signal interval on the same level two sections before it, so that a reversed state of the internal-combustion engine can be identified on the basis of the occurrence interval of rotation signals irrespective of before or after terminated cylinder identification. Therefore, there is provided the effect that a cylinder identifying apparatus for an internal-combustion engine capable of avoiding any erroneously-controlled state at the time of reverse without increasing the cost can be obtained.

What is claimed is:

1. A cylinder identifying apparatus for an internal-combustion engine, comprising:

a plurality of cylinders for rotationally driving an internal-combustion engine;

rotation signal generating means for generating a first position signal which is generated at equal intervals correspondingly to each of said cylinders and additionally a second position signal subsequently to said first position signal corresponding to a specified cylinder;

occurrence interval measuring means for measuring the occurrence interval of said signal;

period ratio computing means for computing a ratio of signal occurrence interval between two predetermined sections on the basis of plural measuring results by said occurrence interval measuring means;

signal identifying means for specifying a predetermined signal from among said signal groups by means of the computation based on plural computing results by said period ratio computing means;

cylinder presuming means for presuming a cylinder on the basis of a signal pattern learned after the additional signal is specified; and reversed state identifying means for identifying as a reversed state if when said second position signal added has been identified, the interval of a section immediately before it is larger than that of a signal section on the same level two sections before it, specifying the additional signal being withdrawn on identifying said reversed state.

2. A cylinder identifying apparatus for an internal-combustion engine as defined in claim 1, wherein said reversed state identifying means clears the signal identification result and the signal pattern for cylinder presumption if the result of said signal identifying means and that of said cylinder presuming means disagree with each other after the interval of said signal exceeds a criterion value.

* * * * *